US012181238B1

(12) United States Patent
Raber

(10) Patent No.: US 12,181,238 B1
(45) Date of Patent: Dec. 31, 2024

(54) HYBRID RIFLE REST AND CANTEEN

(71) Applicant: Matthias W Raber, Cochranton, PA (US)

(72) Inventor: Matthias W Raber, Cochranton, PA (US)

( * ) Notice: Subject to any disclaimer, the term of this patent is extended or adjusted under 35 U.S.C. 154(b) by 37 days.

(21) Appl. No.: 18/080,697

(22) Filed: Dec. 13, 2022

(51) Int. Cl.
*F41A 23/02* (2006.01)

(52) U.S. Cl.
CPC ..... *F41A 23/02* (2013.01)

(58) Field of Classification Search
CPC ..... F41A 23/02
See application file for complete search history.

(56) References Cited

U.S. PATENT DOCUMENTS 3,843,032 A * 10/1974 Moran ..... A45F 3/16 D3/202
3,935,657 A * 2/1976 Wade ..... F41A 23/00 42/94
4,139,130 A * 2/1979 Glusker ..... A45F 3/16 224/660
4,176,770 A * 12/1979 Griggs ..... B62J 9/21 224/451
4,189,075 A * 2/1980 Hall ..... A45F 3/08 224/148.2
4,691,371 A * 9/1987 Derby ..... B65D 88/1668 222/530
D322,358 S * 12/1991 Jacober ..... D3/202
5,233,779 A * 8/1993 Shaw ..... F41A 23/02 42/94
5,332,185 A * 7/1994 Walker, III ..... F41A 23/02 248/910
5,333,829 A * 8/1994 Bell ..... F16M 13/00 248/634
5,875,580 A * 3/1999 Hill ..... F41A 23/02 42/94
5,960,741 A * 10/1999 Ballen ..... A01K 7/00 119/51.01
6,253,482 B1 * 7/2001 Peterson ..... F41A 23/16 42/94
6,730,004 B2 * 5/2004 Selsam ..... A63B 21/06 482/106
6,860,054 B1 * 3/2005 Mosher ..... F41A 27/24 42/94
7,992,502 B1 * 8/2011 Davis ..... A47B 23/04 248/444
8,522,470 B2 * 9/2013 Mangum ..... F41C 27/22 89/37.04
9,618,291 B1 * 4/2017 Henderson ..... F41A 23/02
10,048,034 B1 * 8/2018 Reasor ..... F41A 23/16
(Continued)

OTHER PUBLICATIONS

X-Block XL https://web.archive.org/web/20210727174618/https://benchmasterusa.com/product/x-block-xl/ (Year: 2021).*
(Continued)

*Primary Examiner* — Michelle Clement
(74) *Attorney, Agent, or Firm* — Richard K Thomson

(57) ABSTRACT

A hybrid rifle rest and canteen is preferably molded of HDPE with each of its edges having a notch for resting the stock of a rifle during aiming and firing. Each of the notches around the periphery of the hybrid rifle rest and canteen has a differing depth to provide variation in the aiming/firing angle.

5 Claims, 3 Drawing Sheets

(56) References Cited

U.S. PATENT DOCUMENTS

| | | | | |
|---|---|---|---|---|
| D837,923 | S * | 1/2019 | Gleick | D22/108 |
| 10,323,898 | B1 * | 6/2019 | Phillips | F41A 23/16 |
| 10,466,007 | B2 * | 11/2019 | Reasor | F41A 23/16 |
| 10,670,365 | B2 * | 6/2020 | Coleman | F41C 27/22 |
| 10,689,157 | B2 * | 6/2020 | Morine | B65D 21/0201 |
| 10,852,092 | B1 * | 12/2020 | Lindsay | F41A 23/12 |
| 10,890,406 | B1 * | 1/2021 | Whang | F41C 33/001 |
| 11,333,461 | B2 * | 5/2022 | Cauley, Jr. | F41A 23/12 |
| 11,635,272 | B1 * | 4/2023 | Cisnero | F41A 23/10 42/94 |
| 11,796,274 | B2 * | 10/2023 | Cauley, Jr. | F41A 23/16 |
| 11,918,130 | B2 * | 3/2024 | Burden | A47G 19/2222 |
| 2002/0111233 | A1 * | 8/2002 | Lloyd | A63B 69/0091 473/429 |
| 2008/0263928 | A1 * | 10/2008 | Potterfield | F41A 23/16 42/94 |
| 2012/0102806 | A1 * | 5/2012 | Potterfield | F41A 23/04 42/94 |
| 2012/0246991 | A1 * | 10/2012 | Seuk | F41C 33/001 42/94 |
| 2013/0298439 | A1 * | 11/2013 | Mahnke, III | F41A 23/16 42/94 |
| 2014/0215889 | A1 * | 8/2014 | Abdennour | F41A 23/02 42/94 |
| 2015/0292830 | A1 * | 10/2015 | Treadaway | F41A 23/04 42/94 |
| 2018/0328691 | A1 * | 11/2018 | Reasor | F41A 23/16 |
| 2019/0285376 | A1 * | 9/2019 | Bales | F41A 23/16 |

OTHER PUBLICATIONS https://www.amazon.com/Pridefend-Shooting-Construction-Resistance-Stabilization/dp/B09GB7H5HF?th=1 (Year: 2024).*
Pridefend Shooting Rest https://www.youtube.com/watch?v=5JBbyDzrtAs (Year: 2020).*
Amazon.com Pridefend details (Year: 2024).*
X-Block XL (Year: 2021).*
Pridefend Youtube (Year: 2020).*

* cited by examiner

HYBRID RIFLE REST AND CANTEEN

BACKGROUND AND SUMMARY OF THE INVENTION

The present invention is directed to the field of weapon supports. More particularly, the present invention is directed to a hybrid rifle rest and canteen.

Riflemen including military, hunters, and the like, typically use sand bags as rests for the stock end of their weapon to anchor them and provide a siting/range angle for taking their shot. In order to provide a plurality of siting or range angles, multiple sand bags are needed. This means adding significant weight that the rifleman must carry. In addition, a canteen is needed to provide hydrating on a trek of any length.

It is among the objects of this invention to provide a hybrid rifle rest and canteen that can enhance the ease with which the siting angle can be achieved while simultaneously greatly reducing the weight needed to be carried to achieve that objective. The hybrid rifle rest and canteen of the present invention comprises a) a polygonal compartment for retaining fluid, the polygonal compartment having a plurality of sides, a front and a back; b) at least some of the plurality of sides having a notch for supporting a stock of a rifle; c) one of the plurality of sides having a mouth piece closed by a removable cap. More preferably, each of the plurality of sides has a notch for supporting the stock of a rifle, each notch in the plurality of sides has a different depth than each of a remaining plurality of notches. Lastly, the hybrid rifle rest and canteen is preferably made of high density polyethylene (HDPE).

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
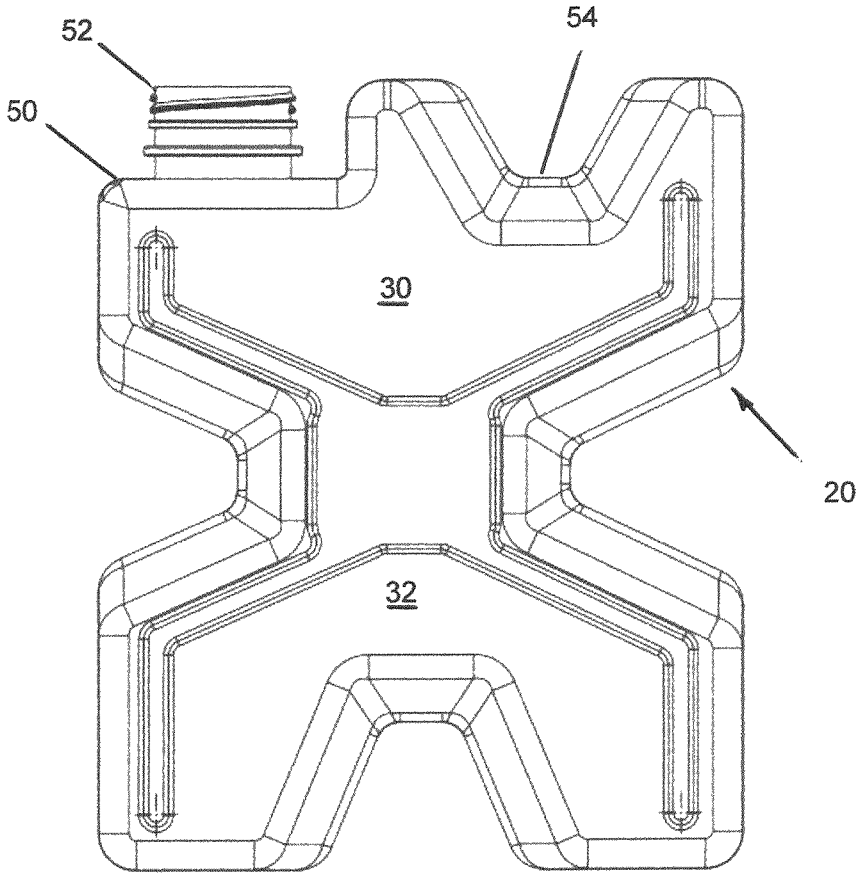
FIG. 1 is a front view of the hybrid rifle rest and canteen of the present invention.
Figure 2:
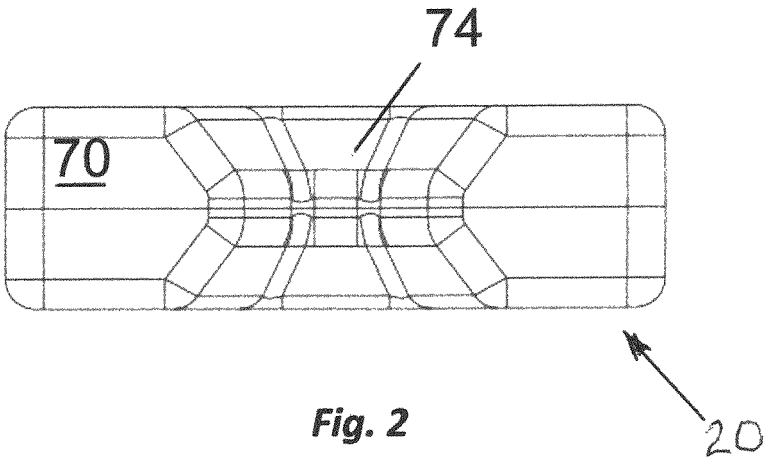
FIG. 2 is a bottom view of the hybrid rifle rest and canteen.
Figure 3:
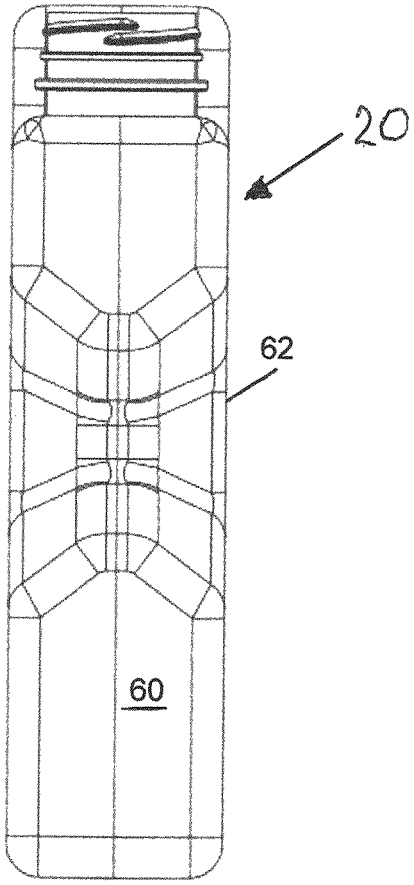
FIG. 3 is right hand view of the hybrid rifle rest and canteen.
Figure 4:
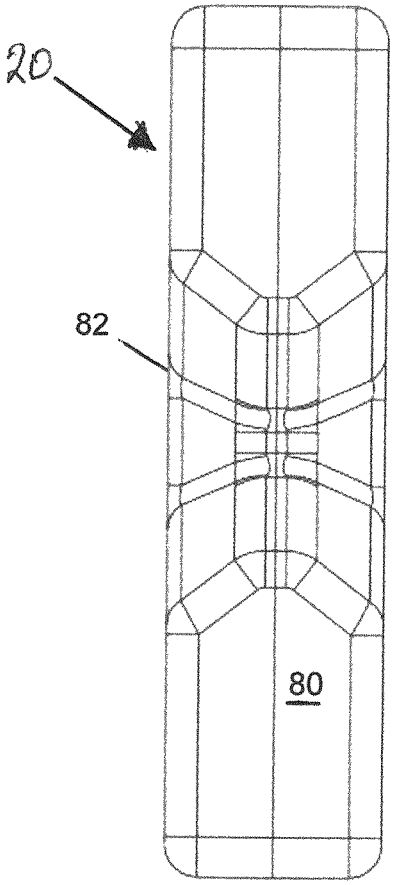
FIG. 4 is left hand view of the hybrid rifle rest and canteen.
Figure 5:
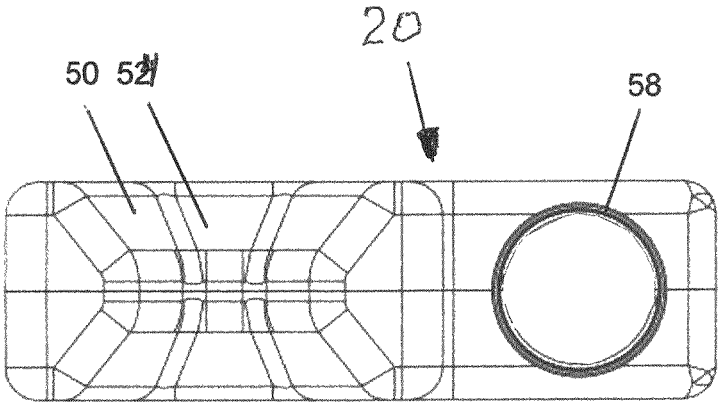
FIG. 5 is top view of the hybrid rifle rest and canteen.
Figure 6:
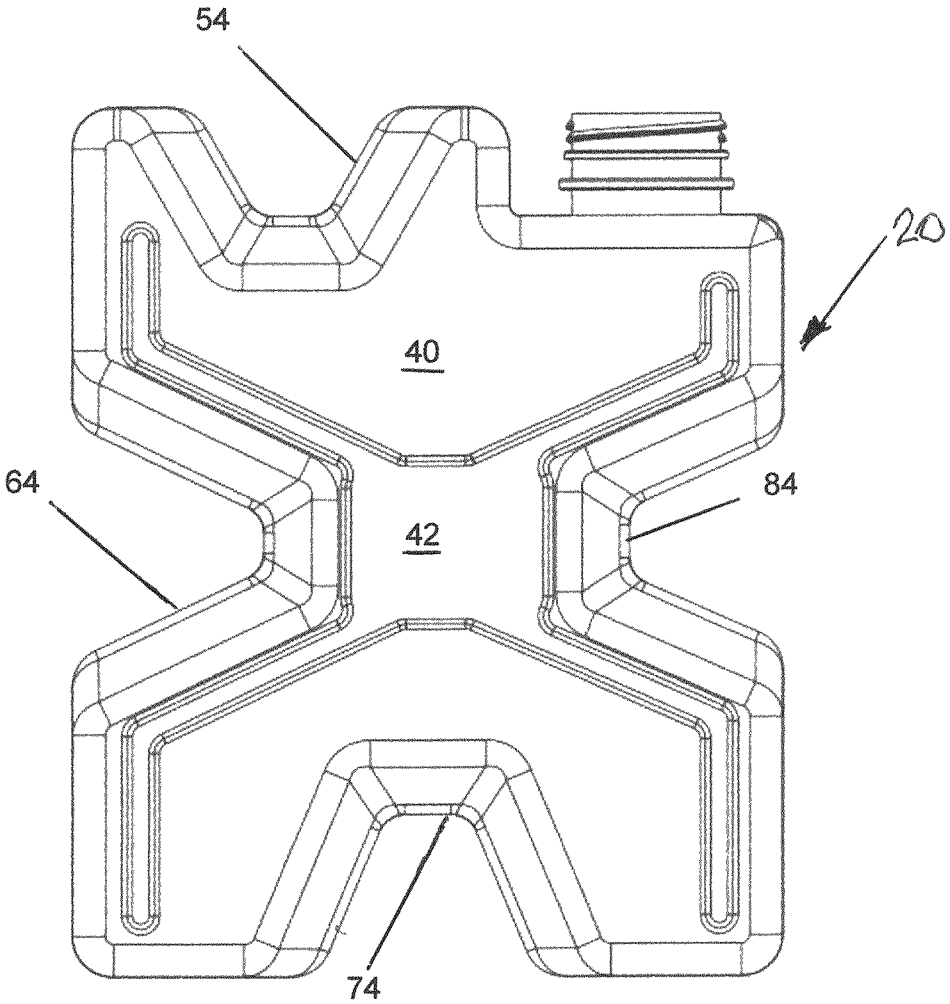
FIG. 6 is rear view of the hybrid rifle rest and canteen.

A first embodiment of the hybrid rifle rest and canteen of the present invention is depicted in FIGS. 1-6 generally at 20. As depicted there, the hybrid rifle rest and canteen 20 is generally rectangular, i.e., 6.5"×8", although other polygonal configurations and sizes are envisioned and considered within the scope of the present invention. As seen in FIGS. 1 and 6, front surface 30 and rear surface 40 of hybrid rifle rest and canteen 20 each has a reinforcing rib pattern 32, 42, respectively, to provide enhanced strength properties to those surfaces.

One of the plurality of sides, 50, 60, 70 and 80, namely top 50, is provided with mouth piece 52 which has external threads 56 that receive internally threaded removable cap 58. Hybrid rifle rest and canteen 20 has a hollow internal cavity for receiving fluid such as water or an energy drink. Top side 50 additionally has a generally V-shaped notch 54 for receiving the stock of a rifle (not shown) for the purpose of steadying the weapon during the aiming/firing processes. Left side 60, bottom 70, right side 80 each have similar V-shaped notches 64, 74, 84, respectively. These notches 54, 64, 74, 84 have varying depths for providing differing targeting angles/distances. By taking the hybrid rifle rest and canteen 20 to a rifle range, the actual range/firing angle associated with each notch can be determined for the particular rifle. A variety of depths for notches 54, 64, 74, 84 can be provided. By way of example and not limitation, these notches can have depths of approximately 1", 1.4", 1.5", and 1.75", respectively.

Hybrid rifle rest and canteen 20 can be made a variety of materials including aluminum and a variety of durable plastic materials with high density polyethylene (HDPE) being preferred.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A hybrid rifle rest and canteen comprising:

a) a polygonal compartment for retaining fluid, said polygonal compartment having a plurality of lateral sides, a front and a back;

b) at least some of said plurality of lateral sides having a notch for supporting a stock of a rifle;

c) one of said plurality of lateral sides having a protruding cylindrical mouth piece with an external thread, said protruding cylindrical mouthpiece being closed by an internally threaded removable cap.

2. The hybrid rifle rest and canteen of claim 1 wherein each of said plurality of lateral sides has a notch for supporting the stock of a rifle.

3. The hybrid rifle rest and canteen of claim 2 wherein each said notch in said plurality of lateral sides has a different depth than each of a remaining plurality of notches.

4. The hybrid rifle rest and canteen of claim 1 wherein said polygonal compartment is made of a durable plastic material.

5. The hybrid rifle rest and canteen of claim 4 wherein said durable plastic material is high density polyethylene.

* * * * *